US006190130B1

(12) United States Patent
Fukue et al.

(10) Patent No.: US 6,190,130 B1
(45) Date of Patent: Feb. 20, 2001

(54) GAS TURBINE MOVING BLADE PLATFORM

(75) Inventors: Ichiro Fukue; Eiji Akita; Kiyoshi Suenaga; Yasuoki Tomita, all of Takasago (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/255,793

(22) Filed: Feb. 23, 1999

(30) Foreign Application Priority Data

Mar. 3, 1998 (JP) ..... 10-050444
Apr. 2, 1998 (JP) ..... 10-090016

(51) Int. Cl.[7] ..... F01D 5/18
(52) U.S. Cl. ..... 416/97 R; 416/96 R; 415/115
(58) Field of Search ..... 415/115, 116; 416/96 R, 97 R, 97 A, 96 A, 95

(56) References Cited

U.S. PATENT DOCUMENTS

| | | | | |
|---|---|---|---|---|
| 4,017,210 | | 4/1977 | Darrow | 416/97 R |
| 4,017,213 | | 4/1977 | Przirembel | 415/115 |
| 4,293,275 | | 10/1981 | Kobayashi et al. | 416/97 R |
| 4,946,346 | | 8/1990 | Ito | 415/115 |
| 5,344,283 | * | 9/1994 | Magowan et al. | 415/115 |
| 5,382,135 | | 1/1995 | Green | 416/97 R |
| 5,779,447 | * | 7/1998 | Tomita et al. | 416/97 R |
| 5,957,657 | * | 9/1999 | Akita et al. | 415/115 |
| 6,017,189 | * | 1/2000 | Judet et al. | 416/97 R |

FOREIGN PATENT DOCUMENTS

| | | | | |
|---|---|---|---|---|
| 27 18661 A1 | | 2/1978 | (DE) . | |
| 64-63605 | * | 3/1989 | (JP) | 416/96 R |
| 8-246802 | | 9/1996 | (JP) . | |
| 10-238302 | | 9/1998 | (JP) . | |
| 95/26458 | | 10/1995 | (WO) . | |

* cited by examiner

*Primary Examiner*—Edward K. Look
*Assistant Examiner*—Richard Woo
(74) *Attorney, Agent, or Firm*—Wenderoth, Lind & Ponack, L.L.P.

(57) ABSTRACT

A gas turbine moving blade platform having a simplified platform cooling structure. A cooling effect of the platform side end portions is increased resulting in uniform cooling of the entire platform. Cooling passages (2, 3) are bored in the platform (1) front portion so as to communicate with a cooling air passage (52) of the moving blade (51) and open at both platform side end surfaces. The openings are closed by inserting covers (2*a*, 2*b*) therein. Cooling passages (6, 4) are bored in platform (1) side end portions so as to communicate with the front end cooling passages (2, 3), respectively, and open in the platform rear end surface. A plurality of cooling holes (5) are bored so as to communicate with the cooling passage (4) and open at the platform side end surface. Thus, the entire platform is cooled uniformly and the platform side portions are cooled by the cooling holes (5) so that an effective cooling performance is ensured and also the workability of the cooling lines is enhanced.

4 Claims, 7 Drawing Sheets

GAS TURBINE MOVING BLADE PLATFORM

BACKGROUND OF THE INVENTION

1. Field of the Invention

The present invention relates to a gas turbine moving blade platform constructed so as to enhance a cooling performance thereof.

2. Description of the Prior Art

FIG. 6 is a cross sectional view of a representative prior art gas turbine moving blade platform, which is an example of that used for a first stage moving blade. In FIG. 6, numeral 50 designates a platform in its entire form and numeral 51 designates a first stage moving blade. Numeral 52 designates a leading edge passage of the moving blade 51 and cooling passages 53, 54 are in communication with the leading edge passage 52 and extend toward respective side portions of the platform 50. The cooling passages 53, 54 connect to cooling passages 55, 56, respectively, on both side portions and the cooling passages 55, 56 open at a rear end of the platform 50 so that cooling air 70 flows out at the rear end of the platform.

In a front portion of the platform 50, there are provided cooling passages 57 and 58, 59 and 60, respectively, on both sides thereof and these cooling passages 57 to 60 are bored at an angle from a lower surface toward an upper surface of the platform 50 to open at the upper surface so that cooling air is blown therefrom. Also, in a rear portion of the platform 50, there are bored cooling passages 61, 62, 63 which also extend at an angle from the lower surface toward the upper surface of the platform 50 to open at the rear end thereof so that the cooling air is blown therefrom.

Further, in a central portion of the platform 50, there are provided cooling passages 64, 65, 66, 67, 68 and these cooling passages are also bored at an angle from the lower surface toward the upper surface of the platform 50 so that the cooling air is blown from the upper surface, wherein an outlet end portion of each of the cooling passages 64 to 68 is enlarged in a funnel-like shape so that the cooling air is diffused on the upper surface.

FIG. 7 is a cross sectional view taken on line C—C of FIG. 6, wherein the cooling passages 55, 56 are provided in both side portions of the platform 50 and the cooling passage 67 is bored at an angle from the lower surface toward the upper surface of the platform 50.

FIG. 8 is a cross sectional view taken on line D—D of FIG. 6, wherein there are provided the cooling passage 55 extending from the front portion toward the rear portion of the platform 50 to open at the rear end and the inclined cooling passages 57, 64 to 68 extending so that the cooling air is blown therethrough rearwardly and upwardly, respectively.

In the platform 50 constructed as above, cooling air which has been supplied into the moving blade 51 through the leading edge passage 52 flows portionally into the cooling passages 55, 56 for cooling both side portions of the platform 50 and to then flow out of the rear end of the platform 50. Also, the cooling passages 57 to 60, and 61 to 63, respectively, are provided in the front and rear portions of the platform 50 so that cooling air is introduced thereinto from the lower surface of the platform 50 to flow out of the upper surface of the front and rear end portions of the platform 50. Further, the cooling passages 64 to 68 are provided in the central portion and cooling air flows therethrough from the lower surface of the platform 50 so as to flow out of the upper surface thereof. Thus, the entire portion of the platform 50 is cooled by the cooling air flowing therein and flowing out thereof.

In the representative prior art gas turbine moving blade platform as described above, there are provided cooling passages 55, 56 which are main cooling passages extending linearly and in addition thereto, there are provided the multiplicity of cooling passages 57 to 60, 61 to 63, etc., which pass through the platform 50 at an angle and thus constitute comparatively long inclined routes. Hence, in the platform 50, there are provided many such cooling air supply passages and thus processing of the platform itself becomes complicated and such a cooling structure for the platform is desired which can be made simpler and still has an excellent cooling effect to cool uniformly the entire portion of the platform including peripheral side portions thereof where there is a severe thermal influence.

SUMMARY OF THE INVENTION

It is therefore an object of the present invention to provide a gas turbine moving blade platform in which supply passages and flow passages of the platform cooling air are simplified so that processing of the platform is facilitated as well as cooling effect of the entire portion of the platform is maintained without being aggravated and especially the platform peripheral side portions are cooled effectively.

In order to achieve said object, the present invention provides the following:

(1) A gas turbine moving blade platform characterized in comprising two cooling passages, each being provided in said platform on each side of the moving blade, communicating at its one end with a leading edge passage of the moving blade and having at its the other end an opening at a side end surface of said platform; a cover for closing said opening of each of said two cooling passages; a side end portion cooling passage, being provided in each side end portion of said platform, communicating at its one end with each of said two cooling passages and having at its the other end an opening at a rear end surface of said platform; and a plurality of cooling holes, each communicating at its one end with any one of said side end portion cooling passages and having at its the other end an opening at the side end surface of said platform.

(2) A gas turbine moving blade platform characterized in comprising a plurality of cooling passages provided in said platform on each side of the moving blade between a leading edge portion and a trailing edge portion of the moving blade, each of said plurality of cooling passages being formed linearly toward a side end surface of said platform and arranged in parallel with each other so as to communicate at its one end with a cooling passage in the moving blade and open at its the other end at the side end surface of said platform.

(3) A gas turbine moving blade platform characterized in comprising a side portion cavity, which forms a cooling passage being provided recessedly in an inner side of said platform on each side of a base portion of the moving blade and extending between a front portion and a rear portion of said platform, said cooling passage being formed snake-wise and opening at a rear end surface of said platform; an inflow side cavity being formed recessedly in an inner side of the front portion of said platform so as to communicate with said side portion cavity; an inflow port for introducing therethrough a cooling air into said inflow side cavity from the inner side of said platform; and a bottom plate for covering recessed opening portions of said inflow side cavity and said side portion cavity.

(4) A gas turbine moving blade platform as mentioned in (3) above, characterized in that said side portion cavity and said inflow side cavity are grooves having same width and said inflow port is a cooling passage in a leading edge portion of the moving blade.

In the platform of item (1) above, there are provided the side end portion cooling passages along both side end surfaces of the platform so that cooling air is introduced thereinto from the leading edge passage of the moving blade through the two cooling passages of the front portion of the platform for cooling of both side portions of the platform to then flow out of the openings at the rear end surface of the platform. Further, there are provided the plurality of cooling holes communicating with any one of the side end portion cooling passages, for example, the side end portion cooling passage on a dorsal side of the moving blade which is exposed to a high temperature combustion gas, and the cooling air is caused to flow from these cooling holes, thereby the side end portion of the platform where there is a severe thermal influence can be cooled effectively with result that the entire portion of the platform can be cooled uniformly.

Still in the platform of item (1) above, there is provided no such complicated and inclined cooling passages as used in the prior art and the cooling lines are constructed simply by the cooling passages extending along both side end surfaces and opening at the rear end surface, thereby the processing of the platform is facilitated.

In the platform of item (2) above, there are provided the plurality of cooling passages extending toward the side end surfaces of the platform between the leading edge portion and the trailing edge portion of the moving blade. Each of these cooling passages communicates with the cooling passage provided in the moving blade and opens at the side end surface of the platform, so that cooling air flows along the entire portion of the platform and flows out of both side end surfaces through the parallel cooling passages. Thereby, the side end portions of the platform where there is a large thermal influence are cooled effectively with the result that the entire portion of the platform can be cooled uniformly. Also, there is provided no such complicated and inclined cooling passages as are used in the prior art and still the cooling passages are arranged in a regular manner, thereby the workability of the platform is enhanced greatly similar to the invention of item (1) above.

In the platform of item (3) above, the cooling air flows into the inflow side cavity from the inflow port for cooling of the front portion of the platform to then flow into the side portion cavities on both side portions of the platform. As the respective side portion cavities are made in serpentine passages of wave shape, the cooling air flows therethrough snake-wise so that both side portions of the platform are cooled effectively with an increased cooling effect and then the cooling air flows out of the rear end surface of the platform. Also, the side portion cavities and the inflow side cavity are provided simply by recessing the inner side of the platform and the recessed opening portions of these cavities are covered by the bottom plates, thereby the cooling passages of the platform are easily formed integrally. Thus, there is provided no such complicated and inclined passages as are used in the prior art and the workability of the cavities or the platform itself is enhanced as well as the cooling air which flows through the cooling area snake-wise so that the heat transfer effect is increased and the cooling effect also is enhanced.

In the platform of item (4) above, the side portion cavities and the inflow cavity are formed by the grooves having same width and the inflow port of the cooling air is the leading edge cooling passage of the moving blade. Thus, the cavities can be made by the grooves that always have the same width and covers therefor can be made likewise with same width. Thereby, forming of the serpentine passages is facilitated so that the workability of the platform is further enhanced than the invention of item (3) above as well as the cooling effect is increased by the serpentine passages of the cooling air like in the invention of item (3) above.

DETAILED DESCRIPTION OF THE PREFERRED EMBODIMENTS

Figure 1A:
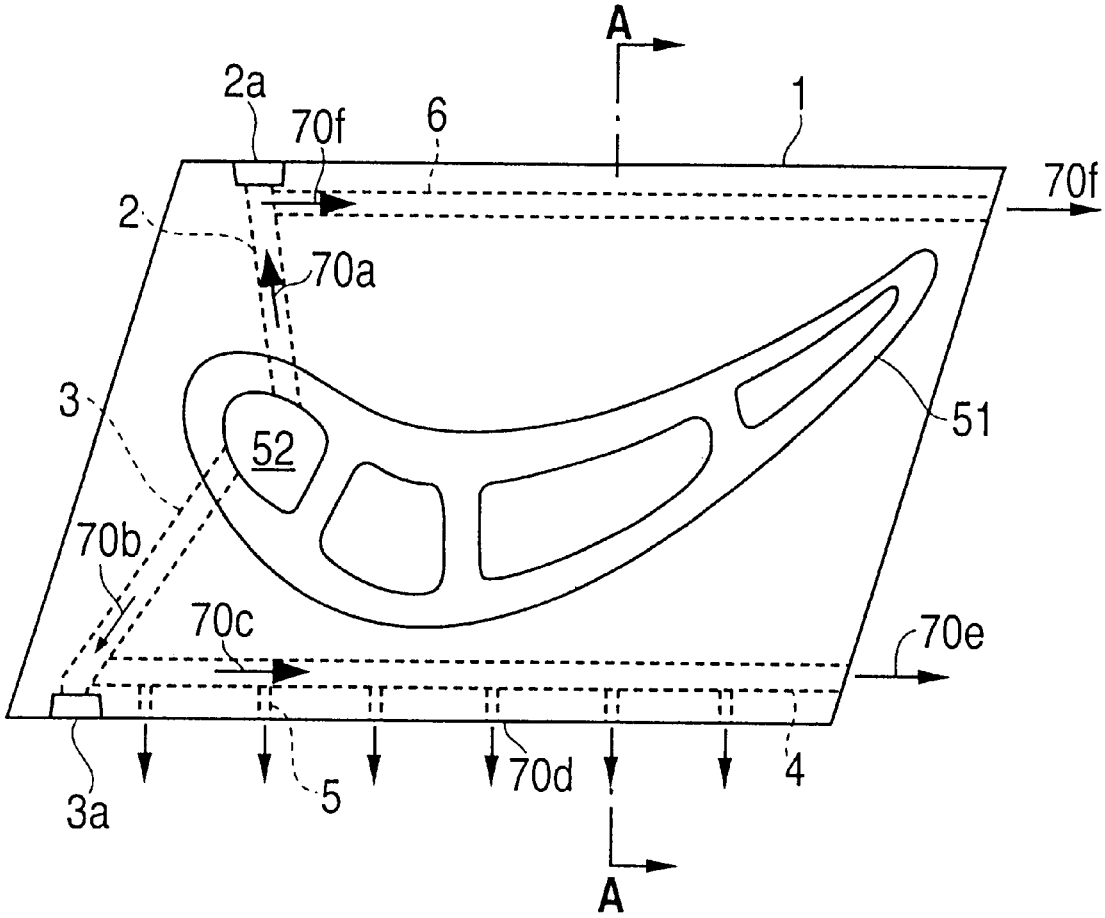
FIGS. 1(*a*)–1(*b*) show a gas turbine moving blade platform of a first embodiment according to the present invention, wherein FIG. 1(*a*) is a plan view of the platform and FIG. 1(*b*) is a cross sectional view taken on line A—A of FIG. 1(*a*).
Figure 1B:
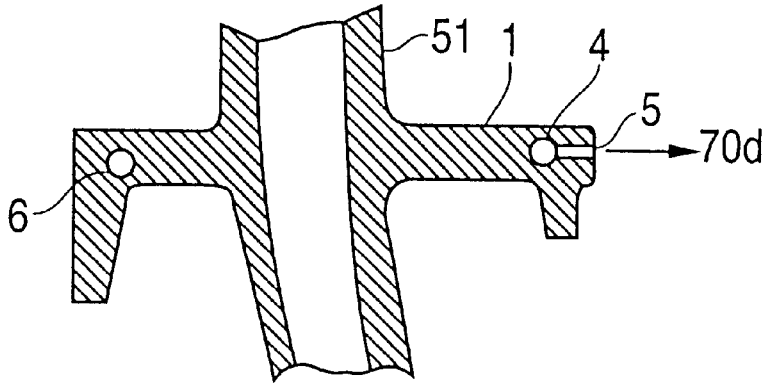

Herebelow, embodiments according to the present invention will be described with reference to the accompanying figures. FIGS. 1(*a*)–1(*b*) show a gas turbine moving blade platform of a first embodiment according to the present invention, wherein FIG. 1(*a*) is a plan view of the platform and FIG. 1(*b*) is a cross sectional view taken on line A—A of FIG. 1(*a*).

In FIG. 1(*a*), numeral 1 designates a platform and numeral 51 designates a moving blade. Numerals 2, 3 designate cooling passages, which are bored in the platform 1 extending right and left, respectively, of a leading edge portion of the moving blade 51. Each of the passages 2, 3 is arranged so as to communicate at its one end with a leading edge passage 52 and extend at its the other end toward a side end surface of the platform 1.

Numeral 4 designates a cooling passage, which is bored in the platform 1 on a blade dorsal side along the side end surface of the platform 1 so as to communicate at its front end with the cooling passage 3 and open at its rear end at a rear end surface of the platform 1. Further, there are provided in the side end portion of the platform 1 a multiplicity of cooling holes 5. Each of the cooling holes 5 is arranged to communicate at its one end with the cooling passage 4 and open at its the other end at the side end surface of the platform 1.

Numeral 6 also designates a cooling passage, which is bored in the platform on a blade ventral side along the side end surface of the platform 1 so as to communicate at its front end with the cooling passage 2 and open at its rear end at the rear end surface of the platform 1.

Numerals 2*a,* 3*a* designate covers. The cover 2*a* is inserted into an opening of the cooling passage 2 for closing the passage 1 and the cover 3*a* is inserted into an opening of the cooling passage 3 for closing the passage 3. By employing these covers 2*a,* 3*a,* when the cooling passages 2, 3 are to be worked in the platform 1, boring of the passages can be facilitated. That is, the cooling passages 2, 3 are completed such that boring work is done to pass through from the side end surfaces of the platform 1 toward the leading edge passage 52 of the moving blade 51, and then the openings at the side end surfaces of the platform 1 are closed by the covers 2*a,* 3*a,* and thus the boring work is simplified.

In the platform 1 constructed as above, cooling air flows into the moving blade 51 from a blade base portion so as to flow toward a blade tip portion through the leading edge passage 52 and a portion thereof flows into the cooling passages 2, 3. The cooling air which has entered the cooling passages 2, 3 flows, as shown by arrows 70*a,* 70*b,* for cooling of a portion of the platform 1 around the leading edge portion of the moving blade 51 and then flows into the cooling passages 4, 6, respectively.

Cooling air 70*c* which has entered the cooling passage 4 flows out of the multiplicity of cooling holes 5 sequentially on the way while flowing through the cooling passage 4 for cooling of the side end portion of the platform 1 on the blade dorsal side and remaining cooling air 70*e* flows out of an opening at the rear end surface of the platform 1. Thus, the side end portion of the platform 1 on the blade dorsal side and the blade leading edge portion which are exposed to high temperature combustion gas with a severe thermal influence can be cooled efficiently.

Cooling air 70*f* which has entered the cooling passage 6 flows through the cooling passage 6 as it is for cooling of the side end portion of the platform 1 on a downstream side of the combustion gas to then flow out of an opening at the rear end surface of the platform 1. In this case, the multiplicity of cooling holes extending toward the side end surface are not provided in consideration of workability of the platform 1 and cooling of the side end portion is effected only by the cooling air 70*f* flowing through the cooling passage 6, which at the same time takes minimum charge of the cooling of a portion approaching to the moving blade 51.

According to the gas turbine moving blade platform of the first embodiment of the present invention as described above, construction thereof is made by the minimum and simplified cooling passages such that the cooling air 70*a,* 70*b* is led from the leading edge passage 52 of the moving blade 51 to flow through the cooling passages 6, 4, respectively, for cooling both of the side end portions of the platform 1. Also, the multiplicity of cooling holes 5 are provided only in the side end portion on the blade dorsal side where there is a severe thermal influence so that the cooling air from the cooling passage 4 is led thereinto for cooling of this side end portion to then flow out thereof as the cooling air 70*d.* Thereby there is no need to provide many such complicated and inclined cooling passages as are used in the prior art, and an entire portion of the platform 1 is cooled efficiently and, in addition thereto, processing of the cooling lines of the platform 1 is facilitated.

Figure 2A:
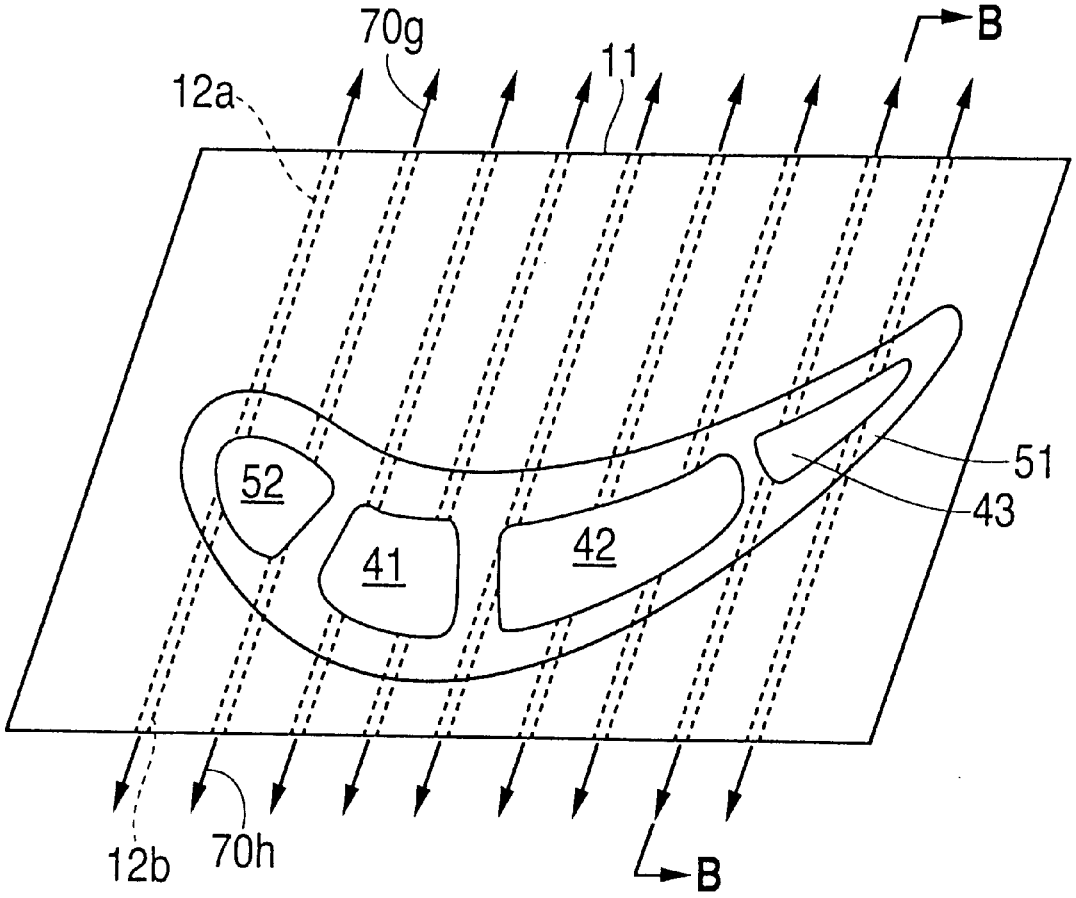
FIGS. 2(*a*)–2(*b*) show a gas turbine moving blade platform of a second embodiment according to the present invention, wherein FIG. 2(*a*) is a plan view of the platform and FIG. 2(*b*) is a cross sectional view taken on line B—B of FIG. 2(*a*).
Figure 2B:
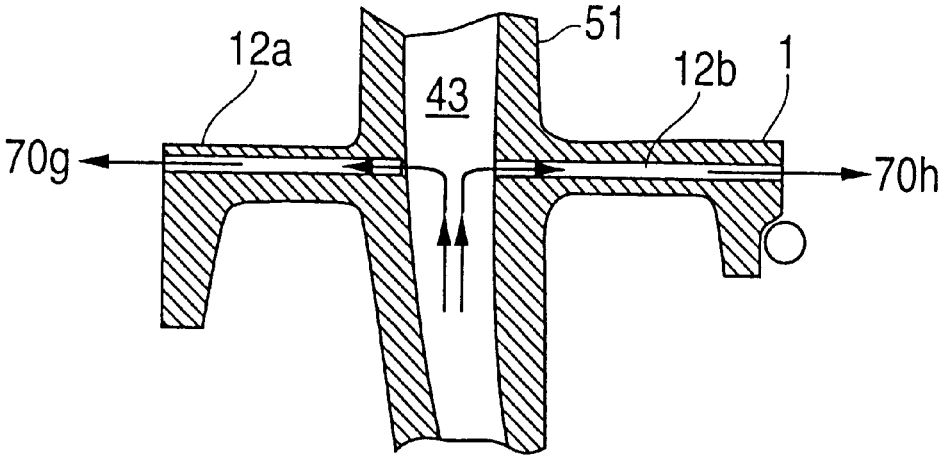

FIGS. 2(*a*)–2(*b*) show a gas turbine moving blade platform of a second embodiment of the present invention, wherein FIG. 2(*a*) is a plan view of the platform and FIG. 2(*b*) is a cross sectional view taken on line B—B of FIG. 2(*a*). In FIG. 2(*a*), numeral 11 designates a platform and numeral 51 designates a moving blade. In the moving blade 51, there are provided a leading edge passage 52, central passages 41, 42 and a trailing edge passage 43 and all of these passages communicate with each other, partly or entirely, in the moving blade 51 so as to form a serpentine cooling passage, although illustration thereof is omitted, so that cooling air flows therethrough for cooling of an entire portion of the moving blade 51.

Numerals 12*a,* 12*b* designate cooling passages, which are bored in the platform 11. Each passage communicates at its one end with the leading edge passage 52 of the moving blade 51 and is open at its the other end at a side end surface of the platform 11, as shown in FIG. 2(*a*). The cooling passage 12*a* is arranged in plural pieces in parallel with each other on a ventral side of the moving blade 51 and the cooling passage 12*b* is arranged in the same number of pieces in parallel with each other on a dorsal side of the moving blade 51 so as to oppose the cooling passage 12*a* on the ventral side.

In the example illustrated in FIG. 2, two of the cooling passages 12*a,* 12*b* communicate with the cooling passages 52, 41, 43, respectively, and three of the cooling passages 12*a,* 12*b* communicate with the central cooling passage 42 and the cooling passages 12*a,* 12*b* are disposed linearly in mutually opposing directions. The cooling air flowing through each of the cooling passages 52, 41, 42, 43 is led portionally into the cooling passages 12*a,* 12*b* to flow therethrough toward the respective side end portions of the platform 11 and to then flow out of openings at the respective side end surfaces as cooling air 70*g* from the cooling passage 12*a* and cooling air 70*h* from the cooling passage 12*b,* so that an entire portion of the platform 11 is cooled uniformly.

According to the gas turbine moving blade platform of the second embodiment as described above, the plurality of cooling passages 12*a,* 12*b* are arranged linearly in parallel with each other not only in the central portion but also in the side end portions of the platform 11. Thereby the entire portion of the platform is cooled uniformly and, in addition thereto, the side end portions of the platform where there is a large thermal influence are cooled effectively as well. The cooling passages are arranged in a regular manner, and thus the workability of the platform is enhanced with the result that further excellent cooling effect and workability are obtained.

It is to be noted that, in the above-mentioned first embodiment, although the example of the cooling passage 6 of a single piece has been described, the present invention is not limited thereto but may naturally be constructed by two sections thereof, or even more sections as the case may be, and the cooling passage 6 need not always be formed linearly.

Also, in the second embodiment, although the example of two sections each of the cooling passages 12*a,* 12*b* communicating with the cooling passages 52, 41, 43, respectively, of the moving blade 51 and three sections each of the cooling passages 12*a,* 12*b* communicating with the cooling passage 42 has been described, the present invention is not limited thereto but three or four sections thereof if allowable space-wise, or even a single passage, may be provided to the respective cooling passages with the number of sections being increased or decreased naturally according to requirements of the design. Further, even if the cooling passages 12*a,* 12*b* are not necessarily disposed in a parallel arrangement, the same effect can be obtained.

Figure 3A:
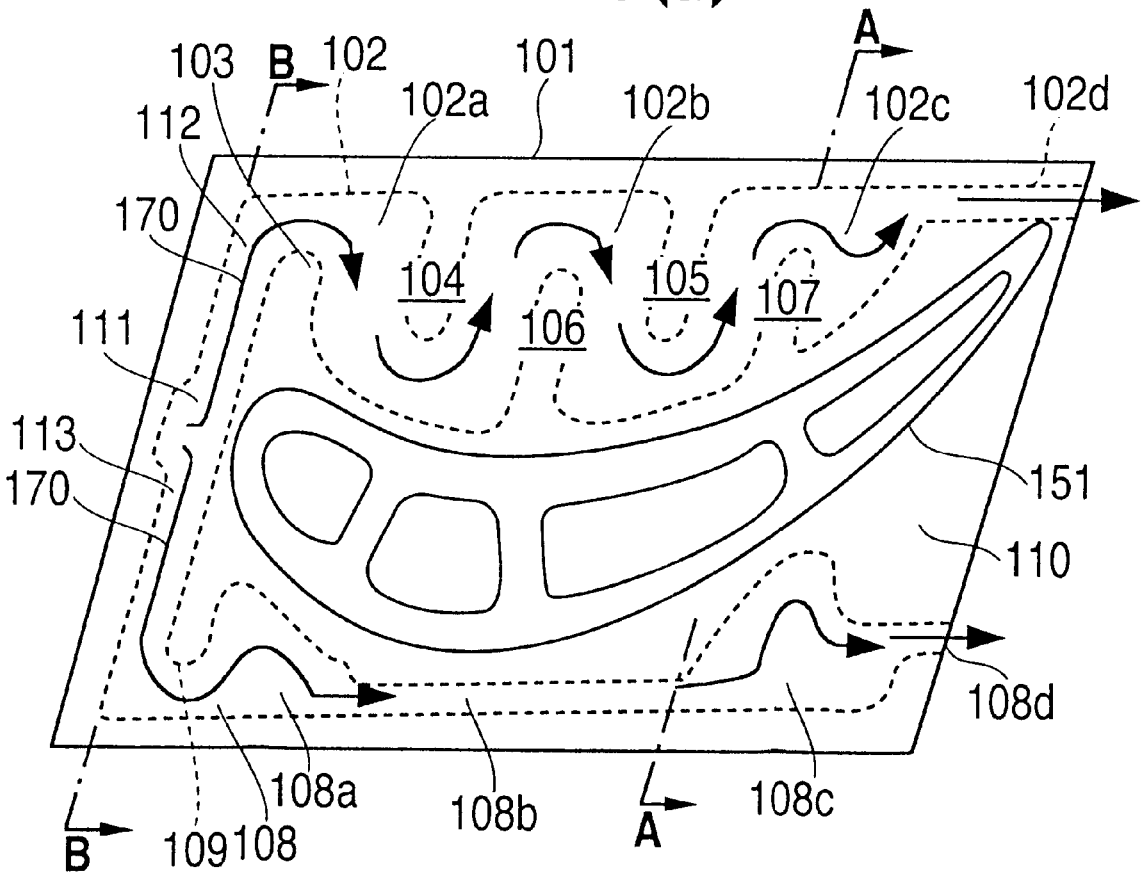
FIGS. 3(*a*)–3(*b*) show a gas turbine moving blade platform of a third embodiment according to the present invention, wherein FIG. 3(*a*) is a plan view of the platform and FIG. 3(*b*) is a cross sectional view taken on line A—A of FIG. 3(*a*).
Figure 3B:
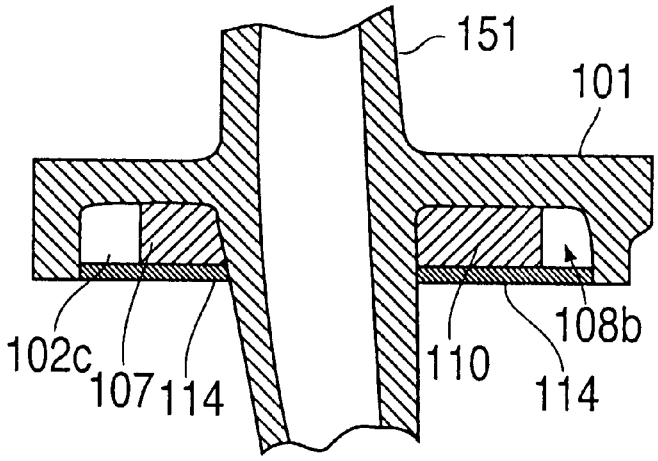

Next, FIGS. 3(*a*)–3(*b*) show a gas turbine moving blade platform of a third embodiment according to the present invention, wherein FIG. 3(*a*) is a plan view of the platform and FIG. 3(*b*) is a cross sectional view taken on line A—A of FIG. 3(*a*).

In FIG. 3, numeral 101 designates a platform and numeral 151 designates a moving blade. Numeral 102 designates a cavity formed in the platform 101. The cavity 102 is recessed in a central portion of the platform 101 on a ventral side of the moving blade 151 by cutting or thinning in a thickness direction of the platform 101 as shown in FIG. 3(*b*), and there is provided a bottom plate 114 for a bottom portion of the cavity 102 as described later.

In the cavity 102, there are provided projections 104, 105 extending toward a ventral surface of the moving blade 151 from a side end portion of the platform 101 in a blade base portion 110 between a leading edge portion and a trailing edge portion of the moving blade 151. Thereby cavities 102*a,* 102*b,* 102*c* are formed in sequential communication with each other so that a linear flow of cooling air therein is interrupted. Also, provided in a rear end portion of the platform 101 is a cavity 102*d* which forms an opening portion extending linearly toward a rear end surface of the platform 101. Further provided in the cavity 102 extending from the blade base portion 110 are a projection 103 in the cavity 102*a,* a projection 106 in the cavity 102*b* and a projection 107 in the cavity 102*c*. Thus, by all these projections including the projections 104, 105, a serpentine flow passage of wave-shape or S-shape is formed in the cavity 102.

Numeral 108 also designates a cavity, which is recessed in the platform 101 on a dorsal side of the moving blade 151 by cutting or thinning in the thickness direction of the platform 101 and a bottom portion thereof is closed by the bottom plate 114. In the cavity 108, there are formed a roughly rounded cavity 108*a,* a linear cavity 108*b,* a roughly rounded cavity 108*c* and an opening cavity 108*d* in sequential communication with each other. Further provided in the cavity 108*a* extending from the blade base portion 110 is a projection 109, and thus an S-type flow passage is formed at an inlet portion of the cavity 108*a*.

Numeral 111 designates a cooling air inflow port, which is formed so as to pass through an inner side bottom surface of the platform 101 so that cooling air is introduced therethrough from an inner side of the platform 101. Numerals 112, 113 designate cooling passages, which are recessed in the platform 101 by cutting or thinning, like the cavities 102, 108, for introducing therethrough cooling air from the cooling air inflow port 111 into the cavities 102, 108 on both sides.

Figure 4:
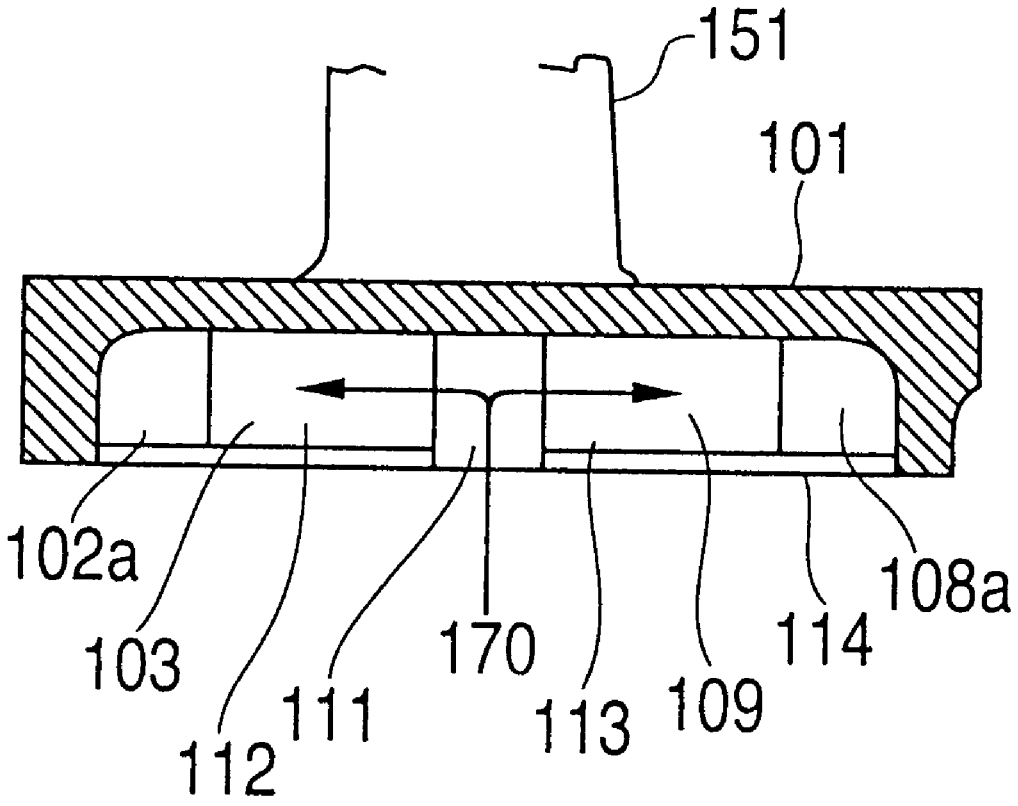
FIG. 4 is a cross sectional view taken on line B—B of FIG. 3(*a*).

FIG. 4 is a cross sectional view taken on line B—B of FIG. 3(*a*). In FIG. 4, the cooling air inflow port 111 opens at a central bottom surface of the platform 101 and communicates with the right and left cooling passages 112, 113, respectively, so that cooling air 170 is introduced therethrough. Also, the cooling passages 112, 113 are formed so as to be recessed in a front end portion of the platform 101 and a bottom portion thereof is covered by the bottom plate 114.

The bottom plate 114 may be provided in any form either of a sectioned form for each of portions covering the cooling passages 112, 113, the cavity 102 and the cavity 108 or of a single form for all the portions covering the cooling passages 112, 113, the cavity 102 and the cavity 108.

In the platform 101 constructed as above, the cooling air 170 enters the cooling passages 112, 113 from the inner side of the platform 101 through the cooling air inflow port 111 for cooling the front portion of the platform 101 and then flows into the cavities 102, 108.

In the cavity 102, the cooling air 170 flows in a serpentine manner through the cavities 102*a,* 102*b,* 102*c* formed by the projections 103, 104, 105, 106, 107 for cooling the entire range therearound of the platform 101 with a cooling effect being enhanced by convection due to the serpentine passage and then flows out of the rear end surface through the cavity 102*d*.

Likewise, in the cavity 108, the cooling air 170 flows in a serpentine manner through the cavity 108*a* formed by the projection 109 for cooling of the front portion of the platform 101 effectively by the serpentine passage to then flow through the linear cavity 108*b* for cooling of a narrow portion near the blade base portion 110 of the platform 101 and to further flow through the cavity 108*c* for cooling of the rear portion of the platform 101 and then flows out of the rear end through the cavity 108*d*.

According to the platform of the third embodiment described above, the construction is made such that there are provided the cavities 102, 108 forming the cooling passages of S-type or wave-type in both side portions of the platform 101, the inner bottom surface of the cavities 102, 108 is covered by the bottom plate 114 and the cooling air is introduced into the cavities 102, 108 from the inflow port 111 through the cooling passages 112, 113, respectively. Thereby the cooling air is introduced into the front portion of the platform 101 for cooling of this portion and then flows in a serpentine pattern in both side portions of the platform 101 for ensuring cooling of this wide range of both side portions of the platform 101 with an increased heat transfer effect with result that the entire portion of the platform 101 can be cooled uniformly.

Further, in addition to the increased cooling effect as mentioned above, all the cooling lines of the platform 101 are constructed by the cavities 102, 108, which are recessed in the platform 101 by cutting or thinning of the blade base portion 110, the cooling passages 112, 113 and the bottom plate 114, thereby the forming of the platform 101 becomes simplified and the processing thereof is facilitated.

Figure 5A:
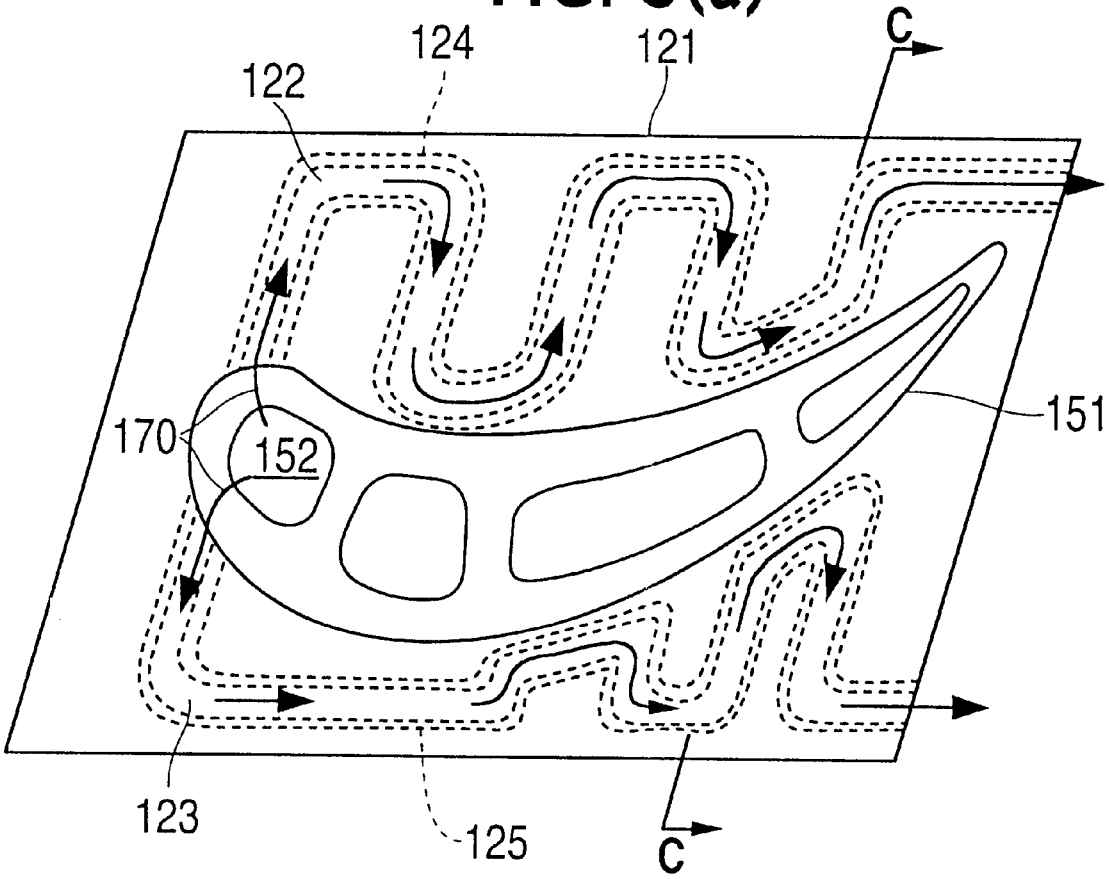
FIGS. 5(*a*)–5(*b*) show a gas turbine moving blade platform of a fourth embodiment according to the present invention, wherein FIG. 5(*a*) is a plan view of the platform and FIG. 5(*b*) is a cross sectional view taken on line C—C of FIG. 5(*a*).
Figure 5B:
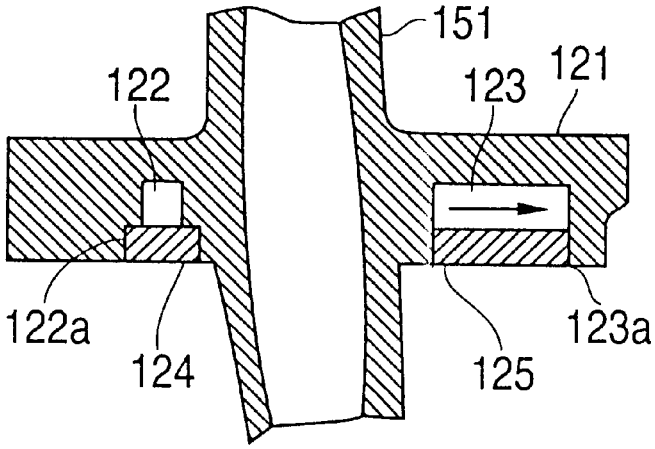
Figure 6:
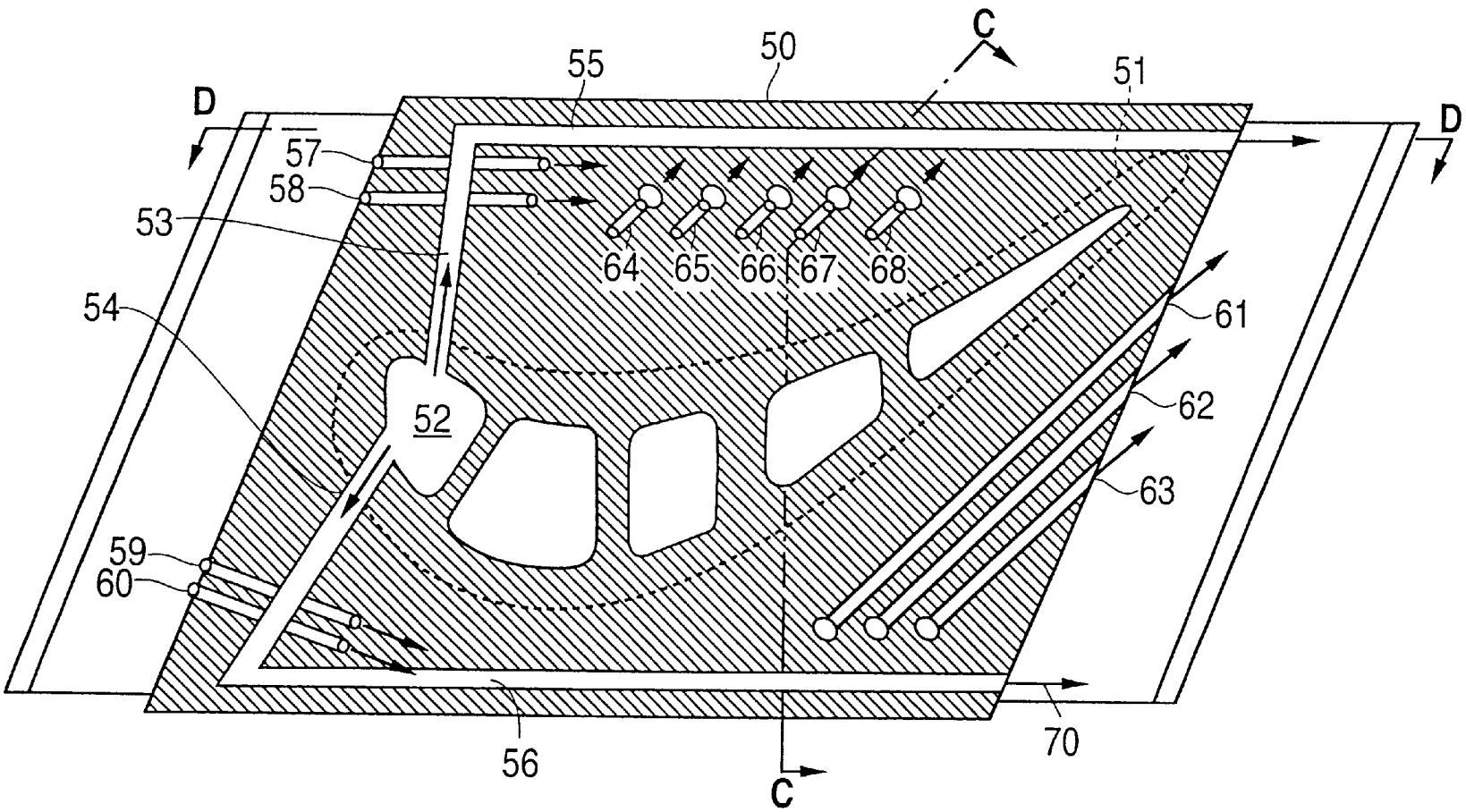
FIG. 6 (PRIOR ART)
FIG. 6 is a cross sectional view of a representative prior art gas turbine moving blade platform.
Figure 7:
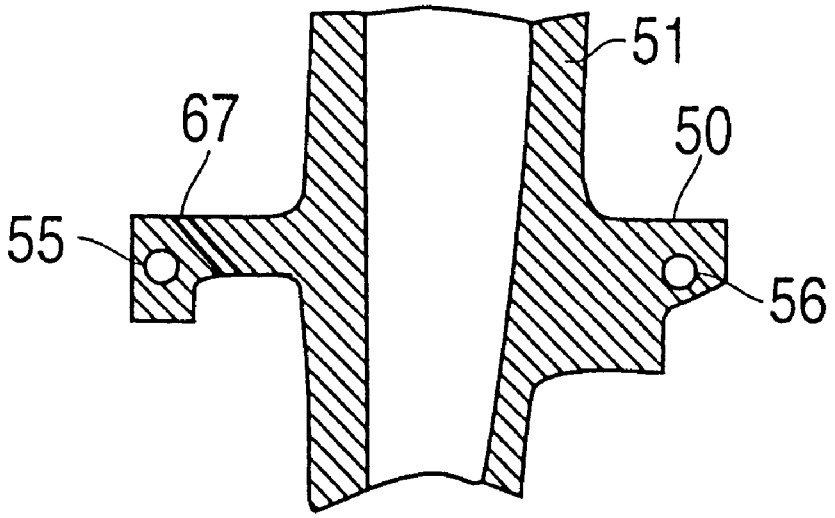
FIG. 7 (PRIOR ART)
FIG. 7 is a cross sectional view taken on line C—C of FIG. 6.
Figure 8:
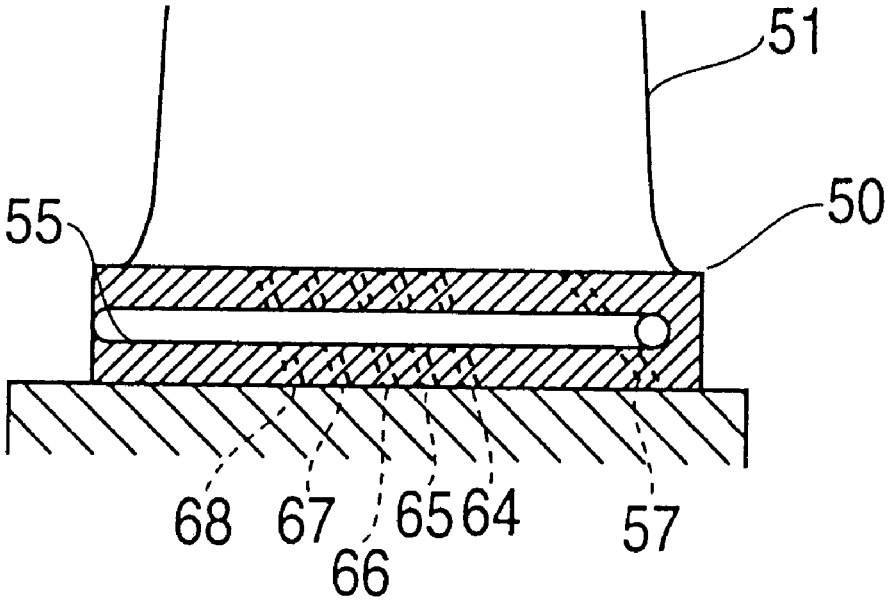
FIG. 8 (PRIOR ART)
FIG. 8 is a cross sectional view taken on line D—D of FIG. 6.

FIGS. 5(*a*)–5(*b*) show a gas turbine moving blade platform of a fourth embodiment according to the present invention, wherein FIG. 5(*a*) is a plan view of the platform and FIG. 5(*b*) is a cross sectional view taken on line C—C of FIG. 5(*a*). In FIG. 5, numeral 121 designates a platform, numeral 151 designates a moving blade and numeral 152 designates a cooling air passage of the moving blade 151. Numerals 122, 123 designate cooling grooves, which are formed continuously with the same width recessed in an inner side of the platform 121 so as to form a passage of S-type or wave type, as shown in the figure, on a ventral side and a dorsal side, respectively, of the moving blade 151 and to open at a rear end surface of the platform 121.

Each of the cooling grooves 122, 123 is arranged so as to communicate at its one end with the cooling air passage 152 of the moving blade 151 and open at its the other end at the rear end surface of the platform 121, as mentioned above. Also, as shown in FIG. 5(*b*), opening portions of the cooling grooves 122, 123 are provided with covers 124, 125, respectively, to form cooling air passages.

The covers 124, 125 have a slightly wider constant width than the width of the-cooling grooves 122, 123 and the cooling grooves 122, 123 are worked to form a two-stepped shape having stepped grooves 122*a,* 123*a,* respectively, so that the covers 124, 125 are inserted into the stepped grooves 122*a,* 123*a* to close the cooling grooves 122, 123, respectively, so as to form cooling air passages.

In the platform 121 mentioned above, cooling air 170 flows into the cooling grooves 122, 123, respectively, from the cooling air passage 152 of the moving blade 151 to flow along the grooves for cooling of an entire portion from a front portion to a rear portion of the platform 121 and then the cooling air flows out of the rear end surface.

Thus, according to the platform of the fourth embodiment, like in the third embodiment, the construction is made such that there are provided the cooling grooves 122, 123 through which the cooling air flows in a serpentine manner and the covers 124, 125 for closing the cooling grooves 122, 123. Thereby the entire portion of the platform is cooled, uniformly and still the cooling lines are formed only by working the cooling grooves and placing the covers so that the work process is facilitated. Also, the cooling grooves 122, 123 are formed with a single width so as to form a simple shape, as compared with the cavities of the third embodiment, and the groove width thereof is smaller than that of the third embodiment, thereby the processing of the platform is also facilitated.

It is understood that the invention is not limited to the particular construction and arrangement herein illustrated and described but embraces such modified forms thereof as come within the scope of the following claims.

What is claimed is:

1. A gas turbine moving blade platform comprising:

a first cooling passage provided in said platform on a first side of the moving blade, said first cooling passage communicating at one end with a leading edge passage of the moving blade and opening at the other end in a first side end surface of said platform;

a first cover closing the other end of said first cooling passage;

a second cooling passage provided in said platform on a second side of the moving blade, said second cooling passage communicating at one end with the leading edge passage of the moving blade and opening at the other end in a second side end surface of said platform;

a second cover closing the other end of said second cooling passage;

a third cooling passage provided in said platform, said third cooling passage communicating at one end thereof with said first cooling passage and having another end thereof opening in a rear end surface of said platform;

a fourth cooling passage provided in said platform, said fourth cooling passage communicating at one end thereof with said second cooling passage and having another end thereof opening in the rear end surface of said platform; and a plurality of cooling holes formed in the first side end surface of said platform, wherein each of said holes communicates with said third cooling passage which is provided on a dorsal side of the moving blade.

2. A gas turbine moving blade platform comprising:

a first groove formed in an inner side of said platform on a ventral side of a base portion of the moving blade, said first groove having a substantially constant width;

a first cover positioned over said first groove so as to define a first serpentine cooling air passage extending between a front portion and a rear portion of said platform, wherein said first serpentine cooling passage opens in a rear end portion of said platform;

a second groove formed in an inner side of said platform on a dorsal side of the base portion of the moving blade, wherein said first and second grooves have substantially the same width;

a second cover positioned over said second groove so as to define a second serpentine cooling air passage extending between the front portion and the rear portion of said platform, wherein said second serpentine cooling passage opens in a rear end portion of said platform;

a cooling air passage formed in a leading edge portion of the moving blade and communicating with each of said first and second serpentine passages such that cooling air can flow through said cooling air passage and into said first and second serpentine passages.

3. A gas turbine moving blade platform as claimed in claim 2, wherein each of said first and second grooves includes a stepped portion, and said first and second covers are received in said stepped portions of said first and second grooves, respectively.

4. A gas turbine moving blade platform as claimed in claim 2, wherein each of said first and second covers has a constant width that is wider than the width of said first and second serpentine cooling passages, respectively.

* * * * *